US006021635A

United States Patent [19]

Gaag et al.

[11] Patent Number: 6,021,635

[45] Date of Patent: Feb. 8, 2000

[54] DUAL ORIFICE LIQUID FUEL AND AQUEOUS FLOW ATOMIZING NOZZLE HAVING AN INTERNAL MIXING CHAMBER

[75] Inventors: John H. Gaag; Raman Ras, both of Mentor, Ohio

[73] Assignee: Parker-Hannifin Corporation, Cleveland, Ohio

[21] Appl. No.: 08/963,135

[22] Filed: Nov. 3, 1997

Related U.S. Application Data

[60] Provisional application No. 60/033,428, Dec. 23, 1996.

[51] Int. Cl.[7] ..... F23R 3/30; F02C 3/30

[52] U.S. Cl. ..... 60/39.05; 60/39.55; 60/742; 239/400; 239/427.3

[58] Field of Search ..... 60/39.05, 39.06, 60/39.53, 39.55, 742, 748; 239/400, 403, 419, 419.3, 424.5, 427.3

[56] References Cited

U.S. PATENT DOCUMENTS

| | | | |
|---|---|---|---|
| 3,013,732 | 12/1961 | Webster et al. . | |
| 3,638,865 | 2/1972 | McEneny et al. . | |
| 3,685,741 | 8/1972 | O'Sickey . | |
| 3,866,413 | 2/1975 | Sturgess | 239/400 |
| 3,899,884 | 8/1975 | Ekstedt | 60/748 |
| 4,425,755 | 1/1984 | Hughes | 60/39.55 |
| 4,600,151 | 7/1986 | Bradley | 60/39.355 |
| 4,601,428 | 7/1986 | Kurogo | 239/427.3 |
| 4,701,124 | 10/1987 | Maghon et al. . | |
| 4,854,127 | 8/1989 | Vinson et al. . | |
| 4,977,740 | 12/1990 | Madden et al. | 60/39.55 |
| 5,062,792 | 11/1991 | Maghon . | |
| 5,228,283 | 7/1993 | Sciocchetti . | |
| 5,423,178 | 6/1995 | Mains . | |
| 5,435,884 | 7/1995 | Simmons et al. . | |
| 5,484,107 | 1/1996 | Holmes | 239/427.5 |
| 5,615,555 | 4/1997 | Mina | 60/742 |
| 5,622,052 | 4/1997 | Tingle | 60/742 |
| 5,673,552 | 10/1997 | Idleman et al. | 60/748 |

*Primary Examiner*—Ted Kim
*Attorney, Agent, or Firm*—John A. Molnar, Jr.

[57] ABSTRACT

A fuel nozzle of a variety for dispensing an atomized fluid spray into the combustion chamber of a gas turbine engine. The nozzle includes a first fluid conduit extending along a longitudinal central axis from an upstream end to a downstream end portion terminating to define a primary discharge orifice, a second fluid conduit which is received coaxially over the first fluid conduit as extending along the central axis from an upstream end to a downstream end portion terminating to define a secondary discharge orifice disposed generally concentrically with said primary discharge orifice, and a third fluid conduit which is received coaxially over the second fluid conduit as extending along the central axis from an upstream first end to a downstream second end. The outer surface of the downstream end portion of the first fluid conduit and the inner surface of the downstream end portion of the third fluid conduit define therebetween a generally annular, internal mixing chamber. First and second fluid inlet ports are provided as extending along longitudinal first and second port axes in fluid communication with, respectively, the second and third fluid conduits and the mixing chamber. The second inlet port is disposed angularly to the first inlet port such that the second port axis intersects the first port axis within the mixing chamber to define an impingement locus for the admixing of a first fluid from the second fluid conduit and a second fluid from the third fluid conduit.

7 Claims, 2 Drawing Sheets

DUAL ORIFICE LIQUID FUEL AND AQUEOUS FLOW ATOMIZING NOZZLE HAVING AN INTERNAL MIXING CHAMBER

This application claims benefit of Provisional Appln No. 60/033,428 Dec. 23, 1996

BACKGROUND OF THE INVENTION

The present invention relates generally to a liquid-atomizing or other spray nozzle, and more particularly to a dual orifice fuel nozzle having an internal mixing chamber for delivering an aqueous fuel emulsion providing $NO_x$ emission control.

Liquid atomizing nozzles are employed, for example, in gas turbine combustion engines and the like for delivering a metered amount of fuel from a manifold into a combustion chamber of the engine as an atomized spray of droplets for mixing with combustion air. Typically, the fuel is supplied at a relatively high pressure from the manifold into an internal swirl chamber of the nozzle which imparts a generally helical vector component to the fuel flow. The fuel flow exits the swirl chamber through a discharge orifice of the nozzle as a thin, conical vortex of fuel surrounding a central core of air. As the vortex advances away from the discharge orifice, it is separated into a conical spray of droplets. To improve the atomization of the fuel for increased combustion efficiency, the flow through the nozzle may be assisted with a stream of high velocity and/or high pressure air. For some applications, a pair of nozzles are used in combination for increasing the fuel throughput rate or for delivering a second fluid such as water for intermixing with the fuel and combustion air.

In basic construction, fuel nozzle assemblies of the type herein involved are constructed as having an inlet fitting which is configured for attachment to the manifold of the engine, and a nozzle or tip which is disposed within the combustion chamber of the engine as having one or more discharge orifices for atomizing the fuel. A generally tubular stem or strut is provided to extend in fluid communication between the nozzle and the fitting for supporting the nozzle relative to the manifold. The stem may include one or more internal fuel conduits for suppling fuel to one or more spray orifices defined within the nozzle. A flange may be formed integrally with the stem as including a plurality of apertures for the mounting of the nozzle to the wall of the combustion chamber. Appropriate check valves and flow dividers may be incorporated within the nozzle or stem for regulating the flow of fuel through the nozzle. A heat shield assembly such as a metal sleeve, shroud, or the like additionally is included to surround the portion of the stem which is disposed within the engine casing. The shield provides a thermal barrier which insulates the fuel from carbonization or "choking," the products of which are known to accumulate within the orifices and fuels passages of the nozzle and stem resulting in the restriction of the flow of fuel therethrough.

Fuel nozzles are designed to provide optimum fuel atomization and flow characteristics under the various operating conditions of the engine. Conventional nozzle types include simplex or single orifice, duplex or dual orifice, and variable port designs of varying complexity and performance. Representative nozzles of these types are disclosed, for example, in U.S. Pat. Nos. 3,013,732; 3,159,971; 3,912,164; 4,134,606; 4,258,544; 4,613,079; 4,735,044; 5,174,504; 5,269,468; 5,423,178; and 5,435,884.

With respect to nozzles of the noted dual orifice variety, such nozzles are constructed, as is illustrated in U.S. Pat. No. 5,423,178, of a pair of coaxially-disposed, generally-tubular body members which define primary and secondary fuel passages. The primary fuel passages extends to a primary discharge orifice of the nozzle via a swirl chamber, plug, slots, or the like for developing a generally helical flow pattern. The secondary fuel passage, in turn, extends to a secondary, usually annular, discharge orifice disposed radially concentrically about the central primary orifice. A flow divider may be provided to direct fuel flow through only the primary orifice for efficient atomization at low throughput rates for discharged, and through both the primary and secondary orifices for higher throughput rates.

As described, the primary and secondary orifices of dual orifice nozzles typically are utilized to provide a frusto-conical atomization profile which may be characterized as including a narrower, interior fuel cone from the primary orifice and a wider, exterior fuel cone from the secondary orifice. Proposals have been made, however, for additionally utilizing the primary or secondary orifice nozzles for injecting water into the combustion chamber.

In this regard, designers of fuel nozzles are confronted by the dual requirements of lower allowable combustion exhaust emission prescribed by government regulations and high combustion efficiency required by industry. It is known that the admixing of water with the fuel provides a quench that limits the maximum combustion temperature which, in turn, is effective in reducing emissions of nitrous oxides ($NO_x$) in the exhaust gas effluent. Water injection additionally is used for smoke reduction, to minimize carbon formation, i.e., coking, and for thrust augmentation. Conventional nozzle arrangements comprehend the use of external equipment to deliver a pre-emulsified stream of fuel and water to the nozzle, or the delivering of the water from the nozzle as a separate flow stream which is injected from a position located radially outward of the fuel flow stream.

For example, U.S. Pat. No. 4,600,151 discloses a representative fuel injector assembly for a gas turbine engine having water injection capability. The assembly includes an annular shroud within which are received a plurality of concentric sleeves. The sleeves are disposed in a spaced-apart relation to define an outer fuel receiving chamber, an intermediate water or auxiliary fuel receiving chamber, and an inner air-receiving chamber.

U.S. Pat. Nos. 4,701,124 and 5,062,792 disclose another representative fuel nozzle assembly for a gas turbine engine having water injection capability. The assembly includes a pilot burner which is located near an end of a flame tube for generating a pilot flame. A central tube provides fuel to the pilot burner, with water or steam being provided to the fuel via a pair of radially-disposed injection nozzles.

U.S. Pat. No. 5,228,283 discloses another fuel nozzle assembly for reduced $NO_x$ emissions. The assembly includes an elongate water delivery pipe having an interior passageway extending from a rearward end to a forward open end. A mounting coupling is affixed to the exterior of the rearward end of the pipe for its mounting within a rearward end of a fuel nozzle body. The forward end of the pipe is provided with an interior water swirler and an exterior fuel swirler, with the forward end of the fuel nozzle body being provided with an air swirler. Such an arrangement provides an outer conical air spray, an intermediate fuel spray, and an inner conical water spray at the fuel nozzle tip.

U.S. Pat. No. 3,638,865 discloses another dual orifice fuel nozzle for a gas trubine engine. The nozzle includes a shrouded and shielded discharge head. The discharge head is constructed as having an annular orifice and a frusto-conical guide surface. The shroud and the shield define a generally axially-extending passageway which is disposed radially about the head.

U.S. Pat. No. 3,685,741 discloses another dual orifice fuel nozzle for a gas trubine engine. The nozzle includes a primary nozzle body which is disposed between a secondary nozzle body and a housing. The nozzle bodies define primary and secondary fuel passages leading, respectively, to primary and second swirl chambers and discharge orifices. The secondary fuel passage is located centrally of the nozzle tip end, with the primary passage being disposed radially outwardly from the secondary passage.

U.S. Pat. No. 3,013,732 discloses another dual orifice fuel nozzle for a gas turbine engine. Primary and secondary fuel passages are employed to convey fuel through primary and secondary discharge orifices via, respectively, a swirl plug and swirl slots.

U.S. Pat. No. 4,854,127 discloses an air swirler and fuel injector for a gas turbine combustion engine. A primary fuel flow is supplied into a primary combustion zone by an inner annulus of swirling air. A secondary fuel flow is supplied into a a secondary combustion zone by an outer annulus of air for combustion at higher fuel flow rates. The secondary fuel flow may be separately injected into the outer annulus via a conduit, or combined with the primary fuel in the injector body.

As aforementioned, methodologies for providing $NO_x$ emmision control heretofore have involved the use of external mixing equipment or conventional dual orifice nozzle arrangements. It has been observed, however, that imperfect mixing of the water and fuel components produces concentrations in the combustion zone of water poor and water rich domains. Within the water poor domains are developed temperature localizations which are higher than than optimum for controlling $NO_x$ emission. Likewise, within the water rich domains are developed temperature localizations which are lower than optimum for efficient combustion minimzing hydrocarbon and carbon monoxide generation. Accordingly, it will be appreciated that improvements in the design of fuel nozzles for water injection would be well-received by industry. A preferred design would ensure uniform mixing of the water and fuel components without the need and expense of external mixing equipment.

SUMMARY OF THE INVENTION

The present invention is directed to a fuel nozzle of a dual orifice variety adapted to deliver an aqueous fuel emulsion for providing $NO_x$ emission control in a gas turbine engine or the like. In having an internal mixing chamber in which an impingement locus is defined for the mixing of, for example, fuel and water fluid flow streams, the nozzle of the present invention obviates the need and expense for external mixing equipment. The impingement mixing of the fuel and water fluid components internally within the nozzle additionally ensures a uniform emulsification of the admixture which minimizes local water concentration gradients. Moreover, as the emulsification is effected immediately prior to the injection of the admixture into the combustion chamber, substantial separation of the emulsion is minimized.

It therefore is a feature of the present invention to provide a fuel nozzle of a variety for dispensing an atomized fluid spray into the combustion chamber of a gas turbine engine. The nozzle includes a first fluid conduit extending along a longitudinal central axis from an upstream end to a downstream end portion terminating to define a primary discharge orifice, a second fluid conduit which is received coaxially over the first fluid conduit as extending along the central axis from an upstream end to a downstream end portion terminating to define a secondary discharge orifice generally concentric with said primary discharge orifice, and a third fluid conduit which is received coaxially over the second fluid conduit as extending along the central axis from an upstream first end to a downstream second end. The outer surface of the downstream end portion of the first fluid conduit and the inner surface of the downstream end portion of the third fluid conduit define therebetween a generally annular, internal mixing chamber. One or more first inlet ports are provided as extending along a longitudinal first port axis in fluid communication with the second fluid conduit and the mixing chamber, and one or more second inlet ports are provided as extending along a longitudinal second port axis in fluid communication with the third fluid conduit and the mixing chamber. Each of the second inlet port is disposed angularly to a corresponding first inlet port such that each second port axis intersects its corresponding first port axis within the mixing chamber to define an impingement locus for the admixing of a first fluid from the second fluid conduit and a second fluid from the third fluid conduit.

It is a further feature of the present invention to provide a method of dispensing fluid components into a combustion chamber of a gas turbine engine of a variety having a fuel nozzle for delivering an atomized fluid spray to the chamber. The method involves providing the nozzle as having an outer fluid passageway extending along a longitudinal central axis, and an inner fluid passageway which is received coaxially through the outer fluid passageway as extending along the central axis from an upstream end to a downstream end portion terminating at a first discharge orifice. The downstream end portion of the inner fluid conduit defines an internal mixing chamber intermediate the upstream end and the secondary discharge orifice thereof. One or more first inlet ports are provided as extending along a longitudinal first port axis in fluid communication with the inner fluid passageway and the mixing chamber, and one or more second inlet ports are provided as extending along a longitudinal second port axis in fluid communication with the outer fluid passageway and the mixing chamber. Each of the second inlet ports is angularly disposed with respect to a corresponding first inlet port such that each second port axis intersects its corresponding first port axis within the mixing chamber to define an internal impingement locus. A first fluid is conveyed through the inner fluid passageway and is injected into the mixing chamber through one or more of the first inlet ports, while a second fluid component is conveyed through the outer fluid passageway and is injected into the mixing chamber through one or more of the second inlet ports. In the mixing chamber, the second fluid component is made to impinge upon the first fluid component within the impingement loci forming an admixture of the first and second fluid components. This admixture is dispensed from the secondary discharge orifice into the combustion chamber of the engine.

Advantages of the present invention include a dual orifice fuel nozzle construction adapted for the internal emulsification of liquid fuel and water fluid components for optimized combustion and $NO_x$ reduction efficiencies. Additional advantages include a nozzle construction which obviates the need for external mixing equipment, and which minimizes separation of the aqueous fuel emulsion. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

These drawings are described further in connection with the following Detailed Description of the Invention.

DETAILED DESCRIPTION OF THE INVENTION

Figure 1:
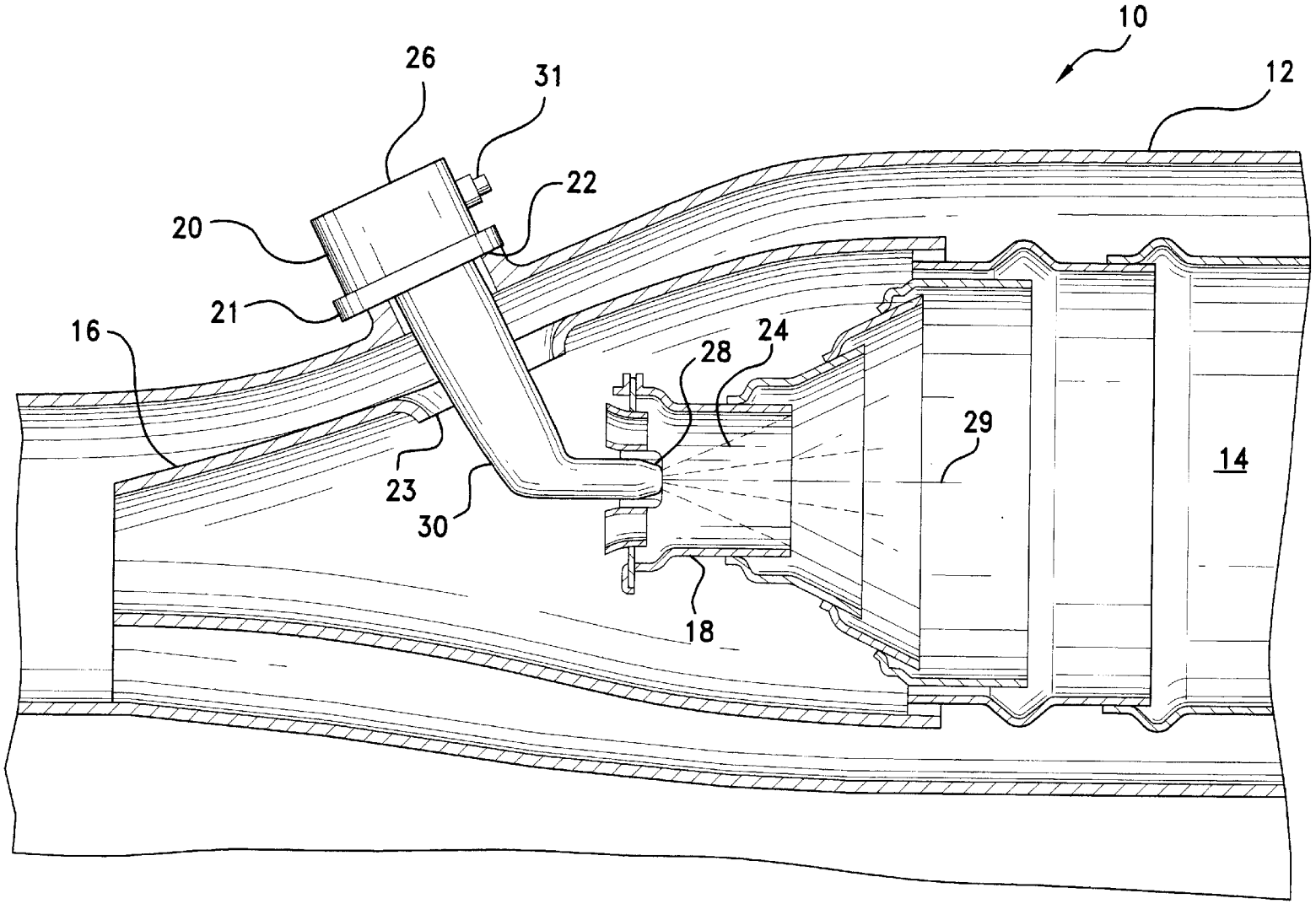
FIG. 1 is a partially cross-sectional view of a combustion assembly for a gas turbine engine as employing the fuel nozzle of the present invention.

Referring to the figures wherein corresponding reference characters are used to designate corresponding elements throughout the several views shown, depicted generally at 10 in FIG. 1 is a combustion system of a type adapted for use within a gas turbine engine for an aircraft or the like. System 10 includes a generally annular or cylindrical outer housing, 12, which encloses an internal combustion chamber, 14, having a forward air diffuser, 16, for admitting combustion air. Diffuser 16 extends rearwardly to a liner, 18, within which the combustion is contained. A fuel nozzle or injector, 20, which may have an integrally-formed, radial flange, 21, is received within, respectively, openings 22 and 23 as extending into combustion chamber 14 and liner 18. An igniter (not shown) additionally may be received through housing 12 into combustion chamber 14 for igniting a generally conical or, as is shown, a dual conical atomizing spray of fuel or like, represented at 24, which is dispensed from nozzle 20.

Nozzle 20 extends into chamber 14 from an external inlet end, 26, to an internal discharge end or tip end, 28, which extends along a longitudinal central axis, 29. Inlet end 26 has a fitting, 31, for connection to one or more sources of pressurized fuel and other fluids such as water. A tubular stem or strut, 30, is provided to extend in fluid communication between the inlet and tip ends 26 and 28 of nozzle 10. Stem 30 may be formed as including one or more internal fluid conduits (not shown) for suppling fuel and other fluids to one or more spray orifices defined within tip end 28.

Figure 2:
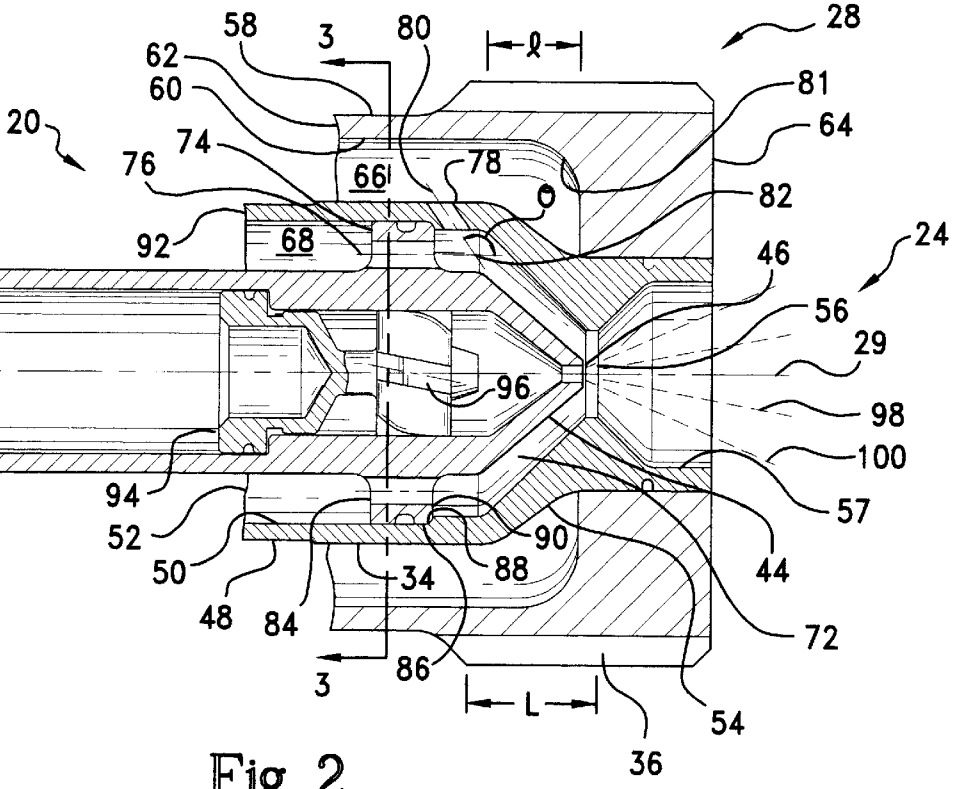
FIG. 2 is a enlarged, partially cross-sectional longitudinal view showing the discharge end of the fuel nozzle of FIG. 1.
Figure 3:
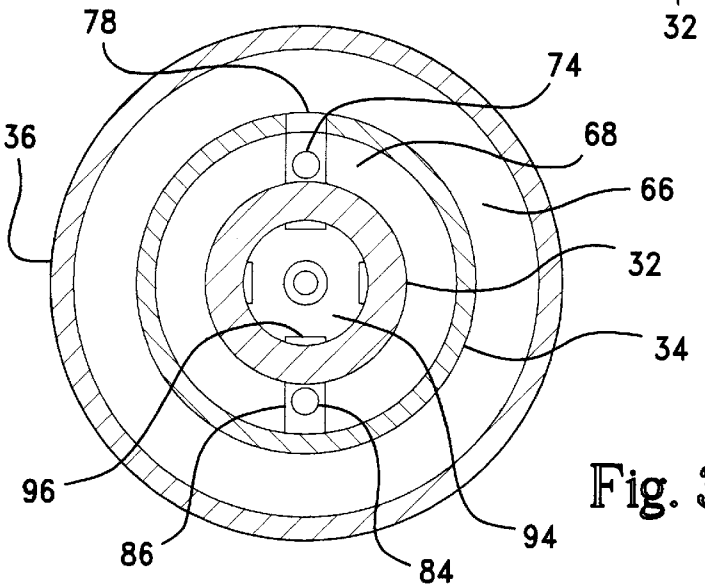
FIG. 3 is a cross-sectional, radial view of the discharge end of the fuel nozzle of FIG. 1 taken through line 3—3 of FIG. 2.

Referring now to FIGS. 2 and 3, discharge end 28 of nozzle 20 is shown in enhanced detail as including a coaxial arrangement of a first fluid conduit, 32, which extends axially along central axis 29, a second fluid conduit, 34, which is received coaxially over first fluid conduit 32, and a third fluid conduit, 36, which is received coaxially over second fluid conduit 34. Each of fluid conduits 32, 34, and 36 may be separately provided, for example, as generally tubular members which extend to inlet end 26 (FIG. 1) of nozzle 20 for forming the body thereof. The separate tubular members may be assembled and then joined using conventional brazing or welding techniques. Alternatively, conduits 32, 34, and 36 may be machined, die-cast, molded, or otherwise formed into an integral body member. The respective diameters of the conduits may be selected depending, for example, on the desired fluid flow rates therethrough, with second and third fluid conduits 34 and 36 being sized progressively smaller than first fluid conduit 32.

First fluid conduit 32, configured as having an outer surface, 38, and an inner surface, 40, extends along central axis 29 from a rearward or upstream end, 42, to a forward or downstream end portion, 44, which terminates to define a generally circular primary discharge orifice, 46. Second fluid conduit 34, also having an outer surface, 48, and an inner surface, 50, likewise extends along central axis 29 from an upstream end, 52, to a downstream end portion, 54, which terminates to define a secondary discharge orifice, 56, disposed generally concentric with primary discharge orifice 46. Optionally, downstream end portion 54 may be provided as extending forwardly beyond secondary discharge orifice 56 to define a radially outwardly flaring shroud portion, 57, for confining atomizing spray 24 dispensed from nozzle 20. As is conventional in fuel nozzles of the instant dual-orifice design, secondary discharge orifice 56 is defined between first conduit outer surface 38 and second conduit inner surface 50 as a generally annular opening which extends radially circumferentially about primary discharge orifice 46. In turn, third fluid conduit 36, also having an outer surface, 58, and an inner surface, 60, extends axially along central axis 29 from an upstream first end, 62, to a downstream second end, 64.

Within each of fluid conduits 32, 34, and 36 is defined an internal fluid passageway for the flow of one or more fluid components therethrough which may be admitted via inlet end 26 (FIG. 1) of nozzle 20. In this regard, an outer fluid passageway, represented at 66, is annularly defined intermediate third fluid conduit inner surface 60 and second fluid conduit outer surface 48, with an inner fluid passageway, represented at 68, being annularly defined intermediate second fluid conduit inner surface 50 and first fluid conduit outer surface 38. A central fluid passageway, 70, defined by the generally cylindrical inner surface 40 of first fluid conduit 32 extends concentrically through outer and inner fluid passageways 66 and 68.

In accordance with the precepts of the present invention, an internal mixing chamber, represented at 72, is disposed intermediate and in fluid communication with the upstream end 42 of second fluid conduit 32 and secondary discharge orifice 56 thereof. Mixing chamber 72 is annularly defined within fluid passageway 68 by the outer surface 38 of first fluid conduit downstream end portion 44 and the inner surface 50 of second fluid conduit downstream end portion 54. With respect to the preferred embodiment illustrated, the downstream end portions 44 and 54 of, respectively, first and second fluid conduits 32 and 34 forwardly extend as tapering radially inwardly relative to central axis 29 to primary and secondary discharge orifices 46 and 56. Mixing chamber 72 is thereby defined as having a generally frustoconical cross-sectional profile.

For admitting fluid into internal mixing chamber 72 fluid, one or more first and second inlet ports are disposed radially about central axis 29. In this regard, a first fluid inlet port is referenced at 74 as extending along a longitudinal first port axis, 76, in fluid communication with second fluid conduit 34 and internal fluid passageway 68 thereof, and mixing chamber 72. Likewise, a second fluid inlet port is referenced at 78 as extending along a longitudinal second port axis, 80. Second end 64 of third fluid conduit 36 preferably is provided to extend radially inwardly to the outer surface 48 of second fluid conduit shroud portion 57 to define a downstream-facing, forward wall portion, 81, that directs the flow of the second fluid component through second fluid ports 78. As is shown in FIG. 2, forward wall portion 81 delineates the forward terminus of third fluid conduit 36 and closes the second end 64 thereof In further accordance with the precepts of the present invention, each second fluid inlet port 78 is angularly disposed with respect to a corresponding first inlet port 74 such that each second port axis 80 intersects a corresponding first port axis 76 within mixing chamber 72. An internal impingement locus, referenced generally at 82 for first and second fluid inlet ports 74 and 78, is thereby defined for the emulsification or other homogeneous admixing of a first fluid component being conveyed through second fluid conduit 34 and a second fluid component being conveyed through third fluid conduit 36. That is, the first and second fluid components are injected into mixing chamber 72 through, respectively, fluid inlet ports 74 and 78 for impingement mixing within the locus 82 defined by the intersection of port axes 76 and 80. For imparting a generally axial, downstream vector component directing the admixed flow of the first and second fluid components through mixing chamber 72, it is preferred that second port axis 80 is oriented to describe a downstream-facing, obtuse angle, represented at θ, with first port axis 74. Angle θ, however, may be described as perpendicular or any downstream or upstream facing angle.

Depending upon the number and orientation of inlet ports 74 and 78, locus 82 may be formed as having a discrete or continuous geometry which may be generally circular, elliptical, or pointwise. The distance, represented in FIG. 2 at "l," from which locus 82 is spaced rearwardly of secondary discharge orifice 56 is not especially critical, but is selected to ensure sufficient admixing of the first and second fluid components within mixing chamber 72.

In the preferred embodiment illustrated in the FIGS. 2 and 3, each of first inlet ports 74 is disposed as extending along each first port axis 76 generally parallel to central axis 29, and is defined as an aperture, one of which is referenced at 84, formed within a radial flange portion, 86, of first fluid conduit 32. Flange portion 86, which may be abuttingly received with a land portion, 88, of second fluid conduit inner surface 50, extends radially outwardly from the outer surface 38 of first fluid conduit 32 the inner surface 50 of second fluid conduit 34, with aperture 84 being formed therebetween. A forward facing surface, 90, is presented by flange portion 86 and forms an internal upstream wall which further defines the axial length, represented in FIG. 2 at "L," of mixing chamber 72 as extending from first inlet port 74 to secondary discharge orifice 56. Again, the distance L is not particularly critical for the purposes of the invention herein involved, but is selected to provide an intimate admixing of the first and second fluid components within mixing chamber 72. First inlet port 74 alternatively may be defined by the generally annular diametric extent of inner fluid passageway 68.

Each second fluid inlet port 78, in turn, may formed as an aperture which extends through the radial tube wall, 92, of second fluid conduit 32. Ports 74 and 78 may be sized depending upon, for example, the flow rates, pressures, viscosities, and densities of the first and second fluid components to effect the intimate admixing thereof.

An optional swirl member or plug, 94, may be received internally within first fluid conduit passageway 70 intermediate upstream end 42 and primary discharge orifice 46 thereof for imparting generally helical vector components to the flow of a third fluid component which may be conveyed through first conduit 32. Swirl member 94 may be of a generally conventional design having an outer surface with a plurality of interstitial channels, one of which is referenced at 96, formed therein which are oriented to define helical fluid flow paths through passageway 70. In this way, third fluid component is dispensed from primary discharge orifice 46 as a central vortex spray, represented at 98, received within an outer conical spray of the admixed first and second fluid components dispensed from secondary discharge orifice 56, represented at 100. Together, sprays 98 and 100 define the atomizing spray 24 which is dispensed from nozzle 20.

Advantageously, the admixing of the first and second fluid components comprising spray 24 is effected internally within nozzle 20 and may be utilized, for example, to introduce an aqueous component for providing $NO_x$ emission control within the combustion chamber of the engine. In this regard, the first and third fluid component may be provided as a distillate hydrocarbon fuel, with the second fluid component being provided as water or another aqueous component. In a typical gas turbine engine, both the volumetric ratio of fuel to water and the volumetric ratio of the fuel flow through primary discharge orifice 46 to the admixed flow through second discharge orifice thereby may be controlled.

With the second fluid being provided as an aqueous component, a homogenized emulsion of water and fuel may be injected into the combustion chamber of the engine to provide a uniform quench for optimized $NO_x$ reduction efficiency. In this regard, as the water and fuel components are internally emulsified within the nozzle immediately prior to injection into the combustion chamber, separation or other breakdown of the emulsion is minimized. Thus, a unique fuel nozzle construction is described herein which obviates the need for external mixing equipment.

Materials of construction for the components forming nozzle 20 of the present invention are to be considered conventional for the uses involved. Such materials generally will be a heat and corrosion resistant, but particularly will depend upon the fluid or fluids being handled. A metal material such as a mild or stainless steel, or an alloy thereof, is preferred for durability, although other types of materials may be substituted, however, again as selected for compatibility with the fluid being transferred. Packings, O-rings, and other gaskets of conventional design may be interposed where necessary to provide a fluid-tight seal between mating elements. Such gaskets may be formed of any elastomeric material, although a polymeric material such as Viton™ (copolymer of vinylidene fluoride and hexafluoropropylene, E.I. du Pont de Nemours & Co., Inc., Wilmington, Del.) is preferred.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed:

1. A method of dispensing fluid components into a combustion chamber of a gas turbine engine of a variety having a fuel nozzle for delivering an atomized fluid spray to said chamber, said method comprising the steps of:

(a) providing said nozzle as comprising:

an outer fluid passageway extending along a longitudinal central axis from an upstream first end to a downstream second end;

an inner fluid passageway disposed coaxially with said outer fluid passageway as extending along said central axis from an upstream end to a downstream end portion terminating at a first discharge orifice, said downstream end portion defining an internal mixing chamber disposed intermediate the upstream end and the discharge orifice of said inner fluid passageway;

a central fluid passageway disposed coaxially with said inner fluid passageway as extending along said central axis from an upstream end to a downstream end portion defining a second discharge orifice generally concentric with said first discharge orifice, at least one first inlet port extending along a longitudinal first port axis in fluid communication with said inner fluid passageway and said mixing chamber; and at least one second inlet port extending along a longitudinal second port axis in fluid communication with said outer fluid passageway and said mixing chamber, said second inlet port being disposed angularly to said first inlet port such that said second port axis intersects said first port axis within said mixing chamber defining an internal impingement locus, (b) conveying a distillate fuel first fluid component through said inner fluid passageway;

(c) conveying an aqueous second fluid component through said outer fluid passageway;

(d) conveying a distillate fuel third fluid component through said central fluid passageway;

(e) injecting said first fluid component into said mixing chamber through said first inlet port;

(f) injecting said second fluid component into said mixing chamber through said second fluid port to impinge upon said first fluid component within said impingement locus forming an admixture of said first and second fluid components;

(g) dispensing said admixture from said discharge orifice into said combustion chamber as an outer conical spray; and (h) dispensing said third fluid component from said second discharge orifice into said combustion chamber as a central spray disposed within said outer conical spray.

2. The method of claim 1 wherein said first and second fluid components are immiscible and said admixture is dispensed in step (g) as an emulsion of said first and second fluid components.

3. The method of claim 1 wherein said internal mixing chamber of said nozzle is annularly defined within the downstream end portion of said inner fluid passageway.

4. The method of claim 3 wherein said internal mixing chamber tapers radially inwardly towards said first discharge orifice in a generally frustoconical cross-sectional profile.

5. The method of claim 1 wherein said first inlet port of said nozzle extends along said first port axis generally parallel to said central axis.

6. The method of claim 5 wherein the second port axis of said second inlet port defines a downstream-facing obtuse angle with the first port axis of said first inlet port.

7. The method of claim 1 wherein said nozzle further comprises a swirl member received internally within the downstream end portion of said central fluid passageway intermediate the upstream end and the second discharge orifice thereof, said member being formed as having an outer surface with a plurality channels formed therein oriented to define fluid flow paths imparting general helical flow vectors to said third fluid flowing through said central fluid passageway, and wherein said third fluid component is dispensed from said second discharge orifice as having a generally helical flow pattern.

* * * * *